US007802973B2

(12) United States Patent
Fujita et al.

(10) Patent No.: US 7,802,973 B2
(45) Date of Patent: Sep. 28, 2010

(54) COMPACT VANE PUMP WITH MIXED SUCTION AND RETURN FLOWS

(75) Inventors: Tomoyuki Fujita, Kani (JP); Masamichi Sugihara, Kani (JP)

(73) Assignee: Kayaba Industry Co., Ltd., Tokyo (JP)

( * ) Notice: Subject to any disclaimer, the term of this patent is extended or adjusted under 35 U.S.C. 154(b) by 196 days.

(21) Appl. No.: 11/733,733

(22) Filed: Apr. 10, 2007

(65) Prior Publication Data

US 2007/0243094 A1 Oct. 18, 2007

(30) Foreign Application Priority Data

Apr. 12, 2006 (JP) ..... 2006-109523

(51) Int. Cl.
*F03C 4/00* (2006.01)
*F04C 2/00* (2006.01)
*F04C 15/00* (2006.01)

(52) U.S. Cl. ..... 418/132; 418/133; 418/268; 417/300

(58) Field of Classification Search ..... 418/15, 418/259, 266–268, 270, 132, 133; 417/300, 417/53, 77, 80, 87–89, 198
See application file for complete search history.

(56) References Cited

U.S. PATENT DOCUMENTS 5,074,825 A * 12/1991 Hamasaki et al. ..... 464/2
5,147,183 A * 9/1992 Gettel ..... 417/300
5,802,848 A * 9/1998 McClendon et al. ..... 60/426
5,943,861 A * 8/1999 Davison et al. ..... 60/453
6,390,783 B1 * 5/2002 Wong et al. ..... 417/53

FOREIGN PATENT DOCUMENTS

JP 3717850 B2 9/2005
JP 2006-009580 A * 1/2006
JP 2008-248833 A 10/2008
WO WO 01/55596 A1 8/2001

OTHER PUBLICATIONS

JP 2006-009580 A—English Translation.*

* cited by examiner

*Primary Examiner*—Theresa Trieu
(74) *Attorney, Agent, or Firm*—Wells St. John PS

(57) ABSTRACT

A vane pump can effectively utilize the total quantity of a working fluid delivered from a vane section. The pump can be used for fluid pressure operated equipment requiring a high flow rate, does not create torque loss due to a throttle valve, and can prevent the occurrence of cavitation caused by a shortage of suction. The vane pump pressurizes and delivers a working fluid through a vane section. A returning working fluid flowing through a return port is throttled and accelerated by a throttle valve, and a working fluid sent from a suction port is attracted by the accelerated returning working fluid so that the returning working fluid and the working fluid sent from a tank are sent into the vane section.

4 Claims, 6 Drawing Sheets

COMPACT VANE PUMP WITH MIXED SUCTION AND RETURN FLOWS

BACKGROUND OF THE INVENTION

The present invention relates to a vane pump for supplying a working fluid to fluid pressure-operated equipment including hydraulically-operated equipment, which is represented by a torsional rigidity control unit for an automotive stabilizer (hereinafter referred to as an "active stabilizer").

Usually, a vane pump of this type pressurizes a working fluid to a high pressure and delivers it by using a vane section consisting of a rotor that has a plurality of vanes that move in and out of the rotor with the rotation of the rotor, and a cam ring that houses the rotor. The vane pump has a flow control valve to prevent cavitation from occurring due to a negative pressure on the suction side at the time of high-speed rotation.

FIG. 5(*a*) is a sectional view showing one example of a vane pump that is the background art of the present invention, showing by being cut in the shaft center, and FIG. 5(*b*) is a sectional view taken along the line B-B of FIG. 5(*a*).

The vane pump 20 shown in FIG. 5 includes a flow control valve 11, a delivery passage 19, and a delivery port 12 for delivering the working fluid pressurized by the pump, a suction port 13 for drawing the working fluid from a tank (not shown) into the pump, and a reflux path 14 leading from the delivery port 12 to a suction passage 13*b*.

In addition, the vane pump 20 includes a rotor 17*a*, a plurality of vanes 17*b* housed in the rotor 17 and moveable in and out with respect to the rotor 17*a*, a cam ring 17*c* that forms an inner peripheral surface with which the vanes 17*b* that project from the rotor 17*a* come into contact, a cover 18*a* and a side plate 18*b* that confine both sides of the rotor 17*a* etc., and a body 18 that houses these elements, which provide the pumping function, and by which the vane pump 20 functions as a vane pump.

The rotor 17*a*, the vanes 17*b*, and the cam ring 17*c* collectively form a vane section 17. The pumping function of the vane section 17 is the same as that of an ordinary vane pump, and so detailed explanation thereof is omitted.

A throttle valve 15 for throttling the flow path of the delivery port 12 is provided at the tip end of the flow control valve 11.

The flow control valve 11 carries out control so that a proper quantity of the working fluid, which is discharged to the delivery port 12 by the rotor 17 in constant rotation driven by torque from an automotive engine, is supplied at a proper pressure as required by hydraulically-operated equipment supplied with the working fluid.

At the same time, excess working fluid flows backward from the delivery port 12 to the suction port 13 through the reflux path 14 as indicated by a reflux Q in FIGS. 5(*a*) and 5(*b*). A shortage of suction to the vane section 17 at the time of high-speed rotation is compensated by this reflux Q, so that the occurrence of negative pressure is prevented, thereby avoiding cavitation.

The vane pump 20 with the flow control valve 11 performs the above-described function. However, some of the working fluid delivered from the vane section 17 forms the reflux Q, and the total quantity thereof is thus not supplied to the hydraulically-operated equipment. The vane pump 20 therefore has a poor efficiency, and is unsuitable for hydraulically-operated equipment that requires a large quantity of working fluid.

In order for the flow control valve 11 to perform the above-described function, the throttle valve 15 is essential. However, a torque loss occurs due to the throttle valve 15, and a solution to this problem has therefore been desired.

On the other hand, as a method for preventing cavitation, a method in which the returning working fluid is accelerated by a nozzle and returned into the tank has been proposed.

FIG. 6 is a sectional view of the essential portion of a different vane pump, another example of a vane pump that is background art to the present invention. This example is described in Patent Document 1.

This vane pump 30 includes a flow control valve 21, a suction port 23, a vane section 27, and a body 28, and has the same function as that of the vane pump 20 shown in FIG. 5. Furthermore, a tank 31 for storing the working fluid is provided adjacent to the vane pump 30.

The tank 31 includes a lead-out port 31*b* for sending the working fluid from the tank 31 to the suction port 23 of the pump 30, and a nozzle 31*a* for throttling and spraying the returning working fluid so that the working fluid is directed to the lead-out port 31*b*.

In the above-described configuration, the vane pump 30 returns the working fluid into the tank 31 by accelerating the returning working fluid via the nozzle 31*a* to promote the suction of working fluid into the suction port 23, and thus prevents the occurrence of cavitation.

However, the flow control valve 21 still remains even in this vane pump 30. Therefore, a problem remains in that the above-described torque loss occurs, and the vane pump 30 is unsuitable for use in fluid pressure-operated equipment that should use most of the working fluid delivered from the vane section 27.

Moreover, the returning working fluid is supplied to the lead-out port 31*b* on the tank 31 side, which is farther from the suction port 23 of the pump 30, so that the acceleration effect is indirect in the pump 30. There may also be a problem in that air is entrapped in the working fluid in the tank 31 when the vehicle experiences vibration.

In addition, for the vane pump 30, the tank 31 must be disposed adjacent to it because of the layout of the lead-out port 31*b* considering the acceleration effect. Accordingly, the degree of freedom in designing the pump 30 is low.

Further, even if the suction is promoted with effort, the outflow direction is at a right angle considering the promotion of suction because the flow control valve 21 is arranged on the axis line of the suction port 23, which presents a problem of significantly decreased acceleration effect.

[Patent Document 1] Japanese Patent No. 3717850 (FIG. 4)

The present invention has been made to solve the above problems, and accordingly an object thereof is to provide a vane pump that can effectively utilize the total quantity of a working fluid delivered from a vane section, that can be used for fluid pressure-operated equipment that requires a high flow rate, that does not create a torque loss due to a throttle valve, and that can prevent the occurrence of cavitation caused by a shortage of suction.

SUMMARY OF THE INVENTION

The present invention provides a vane pump for pressurizing and delivering a working fluid by a vane section, including a suction port for drawing working fluid from a tank to the vane section, and a delivery port for delivering the working fluid which has been pressurized by the vane section, and additionally including a return port for receiving the working fluid that has been delivered from the delivery port, being used and returned, wherein the returning working fluid flowing in through the return port is accelerated by being throttled, and the working fluid sent from the suction port is attracted by the accelerated returning working fluid so that the returning working fluid and the working fluid drawn from the tank are sent into the vane section.

In the vane pump in accordance with the present invention, the returning working fluid flowing in through the return port is accelerated by being throttled, and the working fluid sent from the suction port is attracted by the accelerated returning working fluid so that the returning working fluid and the working fluid sent from the tank are sent into the vane section. Therefore, the vane pump can effectively utilize the total quantity of the working fluid delivered from a vane section, can be used for fluid pressure-operated equipment that requires a high flow rate, does not create a torque loss due to a throttle valve, and can prevent the occurrence of cavitation caused by a shortage of suction.

DETAILED DESCRIPTION OF PREFERRED EMBODIMENTS

Embodiments (examples) of the present invention will now be described with reference to the accompanying drawings.

Figure 1A:
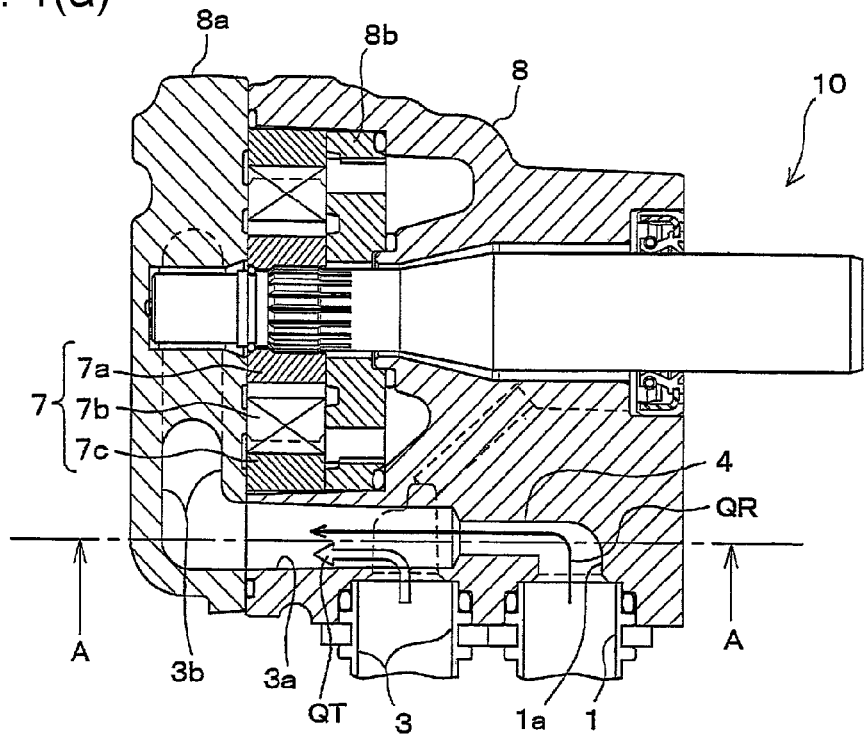
FIG. 1(*a*) is a sectional view showing one example of a vane pump in accordance with the present invention, illustrated as being cut in the shaft center, and FIG. 1(*b*) is a sectional view taken along the line A-A of FIG. 1(*a*)
Figure 1B:
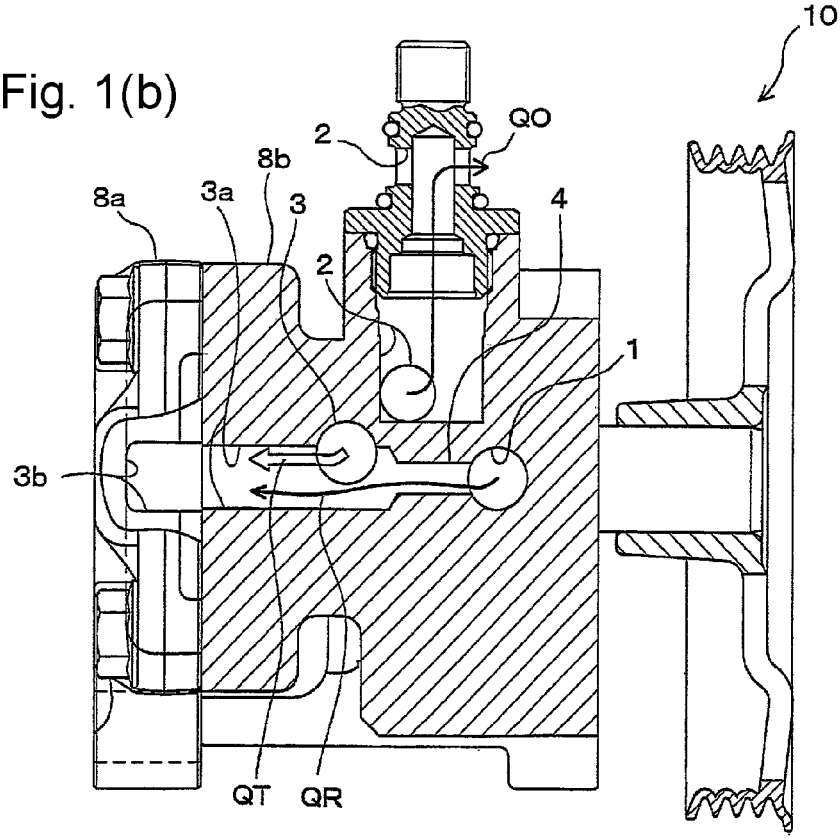

FIG. 1(*a*) is a sectional view showing one example of a vane pump in accordance with the present invention, showing by being cut in the shaft center, and FIG. 1(*b*) is a sectional view taken along the line A-A of FIG. 1(*a*).

The vane pump 10 shown in FIG. 1 is used for supplying a working fluid to an active stabilizer, etc. for an automobile, etc. The vane pump 10 includes a suction port 3 for drawing the working fluid to be sent to a vane section 7 from a tank (not shown), a delivery port 2 for delivering the working fluid pressurized in the vane section 7, and additionally a return port 1 for receiving the working fluid that has been delivered from the delivery port 2, after its use and upon its return. This is a first feature of the vane pump 10.

Also, in the vane pump 10, the returning working fluid flowing in through the return port 1 is throttled by a throttle valve 4 provided in a return passage 1*a* and is accelerated. The working fluid sent from the suction port 3 is attracted by the accelerated returning working fluid so that the returning working fluid and the working fluid sent from the tank are sent into the vane section 7 by conduits 3*a* and 3*b*. This is a second feature of the vane pump 10.

In addition, the vane pump 10 includes a rotor 7*a*, vanes 7*b* capable of moving in and out with respect to the rotor 7*a*, a cam ring 7*c* that includes an inner peripheral surface with which the vanes 7*b* that project from the rotor 7*a* come into contact, a cover 8*a* and a side plate 8*b* that confine both sides of the rotor 7*a*, etc., and a body 8 that houses these elements, which provide the pumping function and thereby allow the vane pump 10 to function as a vane pump.

The rotor 7*a*, the vanes 7*b*, and the cam ring 7*c* collectively form the vane section 7. The pumping function of the vane section 7 is the same as that of an ordinary vane pump like the vane pump 20 shown in FIG. 5, which is background art, and detailed explanation thereof is thus omitted.

The return port 1, the delivery port 2, the suction port 3, the throttle valve 4, and the like, which are features of the vane pump 10, are explained in more detail below.

First, the vane pump 10 does not include a flow control valve of the type that has been provided conventionally at the delivery port 2. All of the high-pressure working fluid QO delivered from the vane section 7 is supplied from the delivery port 2 to the fluid pressure-operated equipment (not shown), which is connected to the delivery port 2 via a delivery passage (not shown).

Figure 5A:
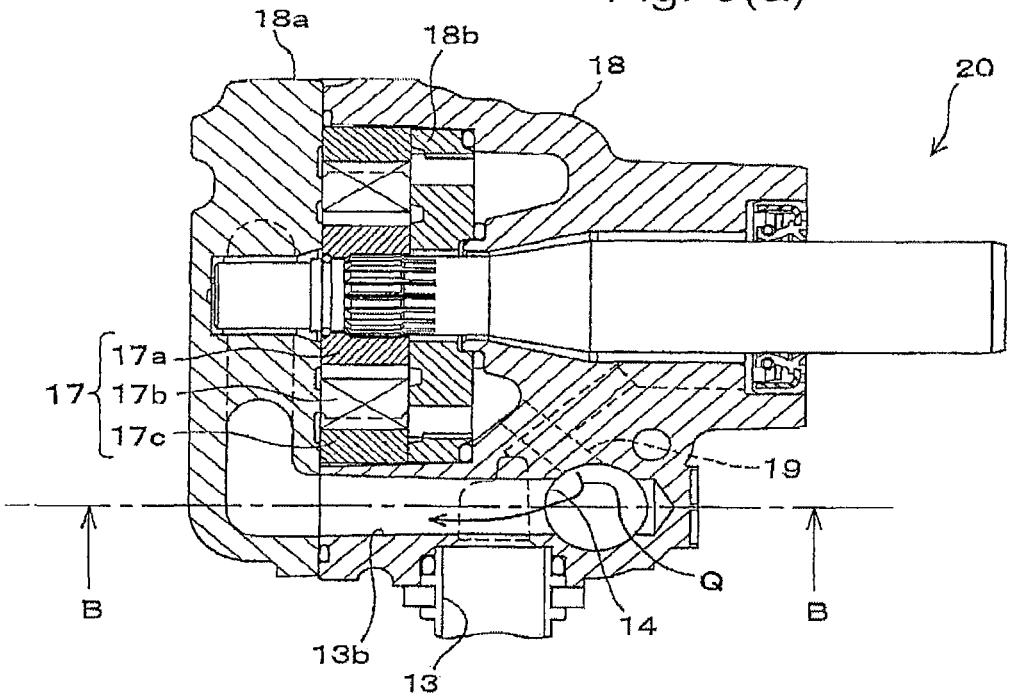
PRIOR ART Fig. 5(a)
FIG. 5(*a*) is a sectional view showing one example of a vane pump that is background art to the present invention, showed in section through the shaft center, and FIG. 5(*b*) is a sectional view taken along the line B-B of FIG. 5(*a*)
Figure 5B:
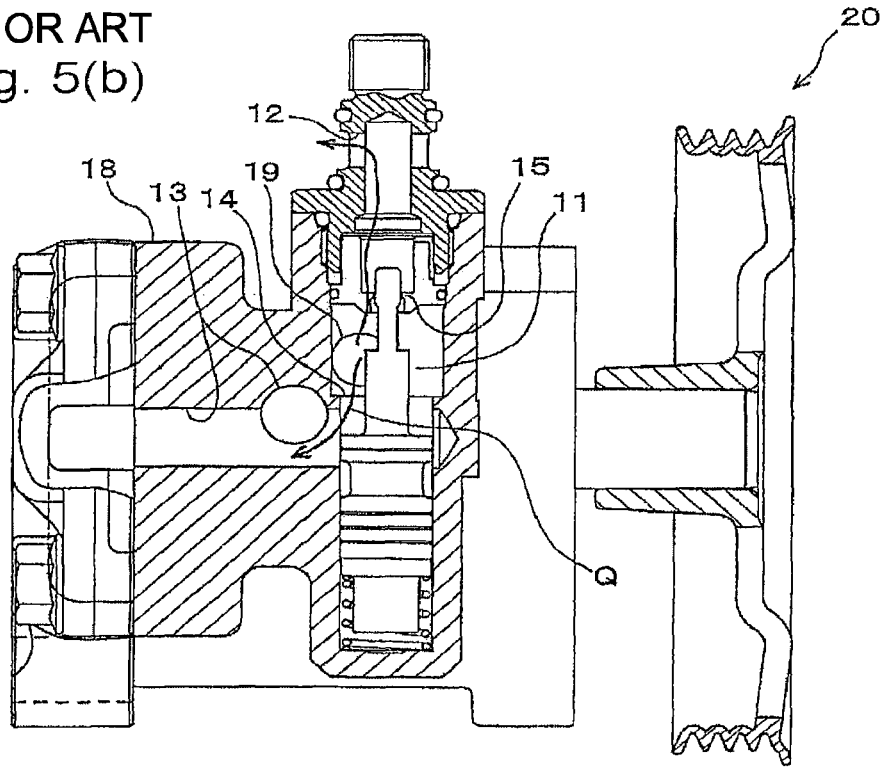
PRIOR ART Fig. 5(b)
Figure 6:
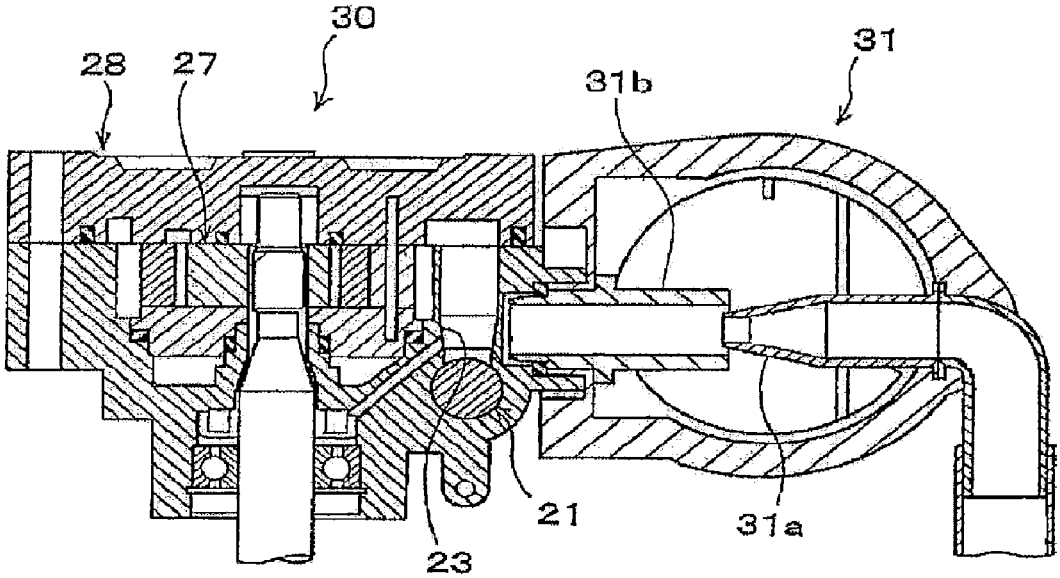
PRIOR ART Fig. 6
FIG. 6 is a sectional view of the essential portion of a vane pump, showing another example of a vane pump that is background art to the present invention.

This point can be confirmed by the fact that in FIG. 1(*b*), the delivery port 2 does not communicate with the suction port 3, and the reflux path 14 that is provided in the vane pump 20 shown in FIG. 5, which is the background art, is absent.

Therefore, the vane pump 10 uses the working fluid efficiently so that the vane pump 10 can be used for fluid pressure-operated equipment that requires a high flow-rate of working fluid, such as an active stabilizer.

Also, the flow control valve is absent from the vane pump 10 described above. Accordingly, a throttle valve for throttling the working fluid QO delivered from the delivery port 2, which has been explained above in the context of the background art, is also absent, so that the loss of driving torque in the vane pump 10 is thereby eliminated.

The return port 1 communicates with the conduit 3*a* in which the suction port 3 is open via the throttle valve 4 provided in the return passage 1*a*. The conduit 3*a* communicates with the conduit 3*b* which is provided on the cover 8*a* for sending the working fluid into the vane section 7.

As the figure illustrates, a returning working fluid QR is throttled and accelerated by the throttle valve 4, and passes through the conduit 3*a* near the suction port 3 in this state. A negative pressure is therefore produced near the suction port 3, and thus the working fluid is pulled from the tank.

Both of the working fluid QT that is drawn from the tank and the returning working fluid QR are sent into the vane section 7 after passing through the conduits 3*a* and 3*b*. For one of various exemplary embodiments of the inventions, an exemplary suction port 3, an exemplary conduit 3*a* and an exemplary working fluid QT collectively represent an exemplary "suction port flow path." Moreover, for one of various exemplary embodiments of the inventions, an exemplary return port 1, an exemplary throttle valve 4 and an exemplary returning working fluid QR collectively represent an exemplary "return port flow path." Still further, for one of various exemplary embodiments of the inventions, an exemplary conduit 3*a* and an exemplary conduit 3*b* collectively represent an exemplary "mixing chamber."

Therefore, in the vane pump 10, even in the case of high-speed rotation, in addition to the returning working fluid QR that has been delivered and returned, the working fluid QT drawn from the tank is sent into the pump 10 as necessary. A negative pressure is thus avoided on the suction side, which prevents cavitation in the fluid.

Accordingly, the vane pump 10 can effectively utilize the total quantity of the working fluid delivered from the vane section 7, can be used for fluid pressure-operated equipment that requires a high flow rate, does not create a torque loss due to the throttle valve, and can prevent the occurrence of cavitation caused by a shortage of suction.

In the vane pump 10, with respect to the conduit 3*a*, the returning working fluid QR that has passed through the throttle valve 4 from the return port 1 and which has been accelerated, and the drawn working fluid QT attracted by the returning working fluid QR pass through the straight line shaped conduit 3*a*, so that the working fluids are accelerated more efficiently and are supplied to the vane section 7 with a low loss caused by flow path resistance.

Also, the return port 1, the throttle valve 4, the suction port 3, and the conduits 3*a* and 3*b* are located in the same pump 10 and close to each other, so that efficiency is improved accordingly.

Further, the tank (not shown) need not necessarily be provided close to the pump 10, so that the arrangement of the vane pump 10 can be considered without much regard to the position of the tank, and hence the degree of design freedom becomes high.

Figure 2:
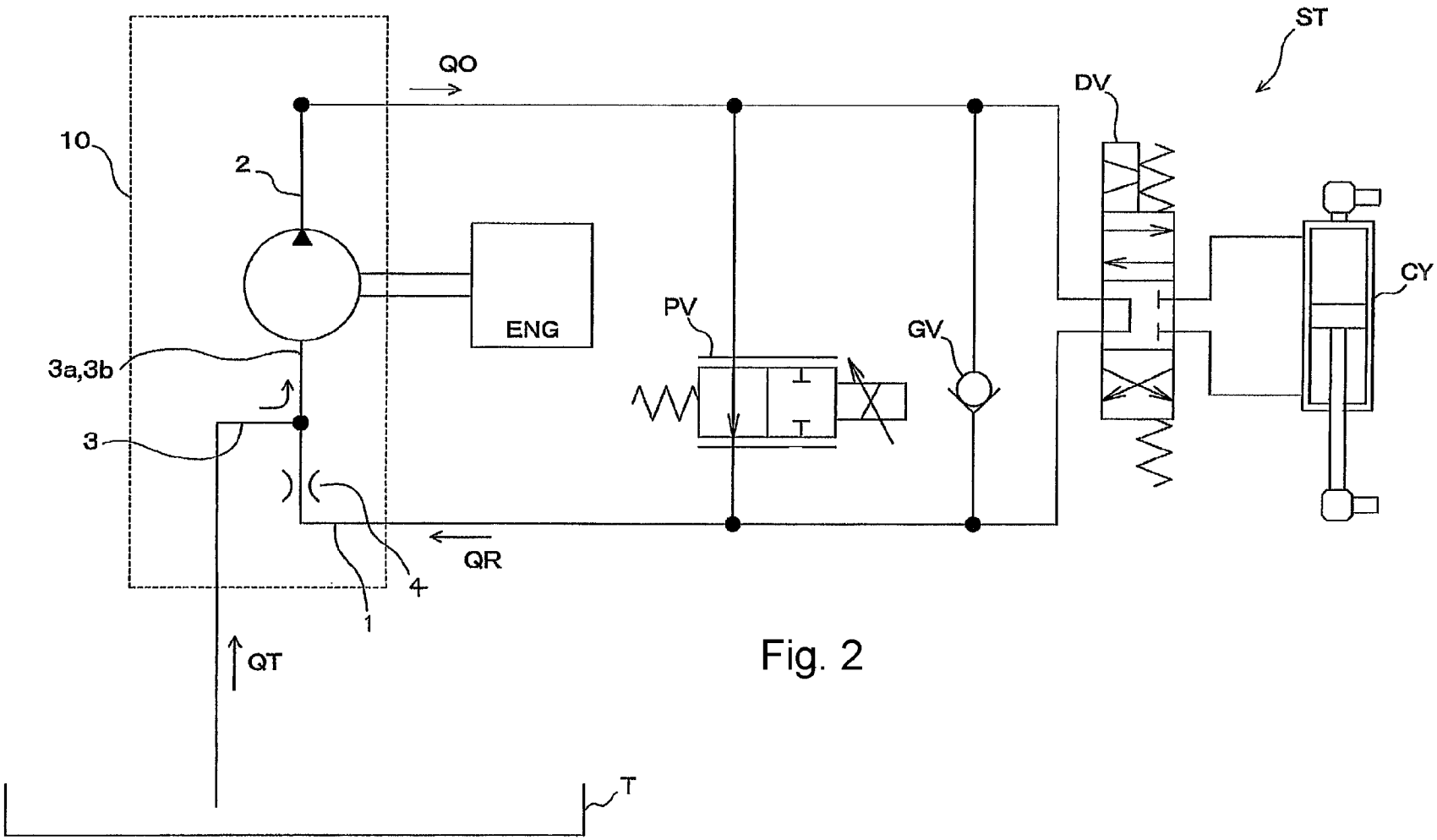
FIG. 2 is a fluid pressure circuit diagram showing fluid pressure-operated equipment using the vane pump shown in FIG. 1.

FIG. 2 is a fluid pressure circuit diagram showing fluid pressure operated equipment using the vane pump shown in FIG. 1. In FIG. 2, the same symbols are applied to the elements already explained above, and duplicated explanation is omitted.

This fluid pressure circuit diagram shows an active stabilizer ST for preventing rolling, etc. of an automobile. The active stabilizer ST includes the vane pump 10, which is driven by an automotive engine ENG, a tank T connected to the suction port 3 of the vane pump 10, a pressure control valve PV provided in parallel in a conduit leading from the delivery port 2 to the return port 1 of the vane pump 10, a check valve GV, a directional selecting valve DV, and a single rod type fluid pressure cylinder CY connected to the output side of the directional selecting valve DV.

As one example, either one of the cylinder side and the rod side of the fluid pressure cylinder CY is connected to the stabilizer and the other thereof is connected to a link arranged so as to project from the stabilizer so that the rolling of a vehicle body is controlled by the fluid pressure cylinder CY, which thereby provides the function of the active stabilizer ST.

When the vane pump 10 is used as a part of the active stabilizer ST, the vane pump 10 can supply a high flow rate of working fluid as required, and can fully perform the function of the active stabilizer ST without producing cavitation.

In the case where the vane pump 10 is used to circulatingly supply the working fluid to the fluid pressure cylinder CY of a single rod type, as in this example, an excess and a deficiency of the circulating working fluid take place between the case where the cylinder CY extends and the case where the cylinder CY contracts. When the working fluid is in short supply, the necessary working fluid is drawn from the tank T via the suction port 3, and when the working fluid is in excess, the excess working fluid is returned to the tank T via the suction port 3. The vane pump 10 in accordance with the present invention is thus suitable in this respect as well.

Also, in the case where the vane pump 10 in accordance with the present invention is used, the total quantity of the working fluid QO delivered from the delivery port 2 becomes, in principle, the same as that of the returning working fluid QR. However, depending on the type of fluid pressure-operated equipment, in some cases it is better to utilize some of the working fluid QO for other applications in the equipment. The working fluid used for such an objective can be returned to the tank T by another circuit such as a drain circuit.]

Therefore, in such a case, the total quantity of the working fluid QO delivered is sometimes not the same as that of the returning working fluid QR. However, the working fluid is nevertheless utilized effectively on the fluid-pressure operated equipment side.

Figure 3:
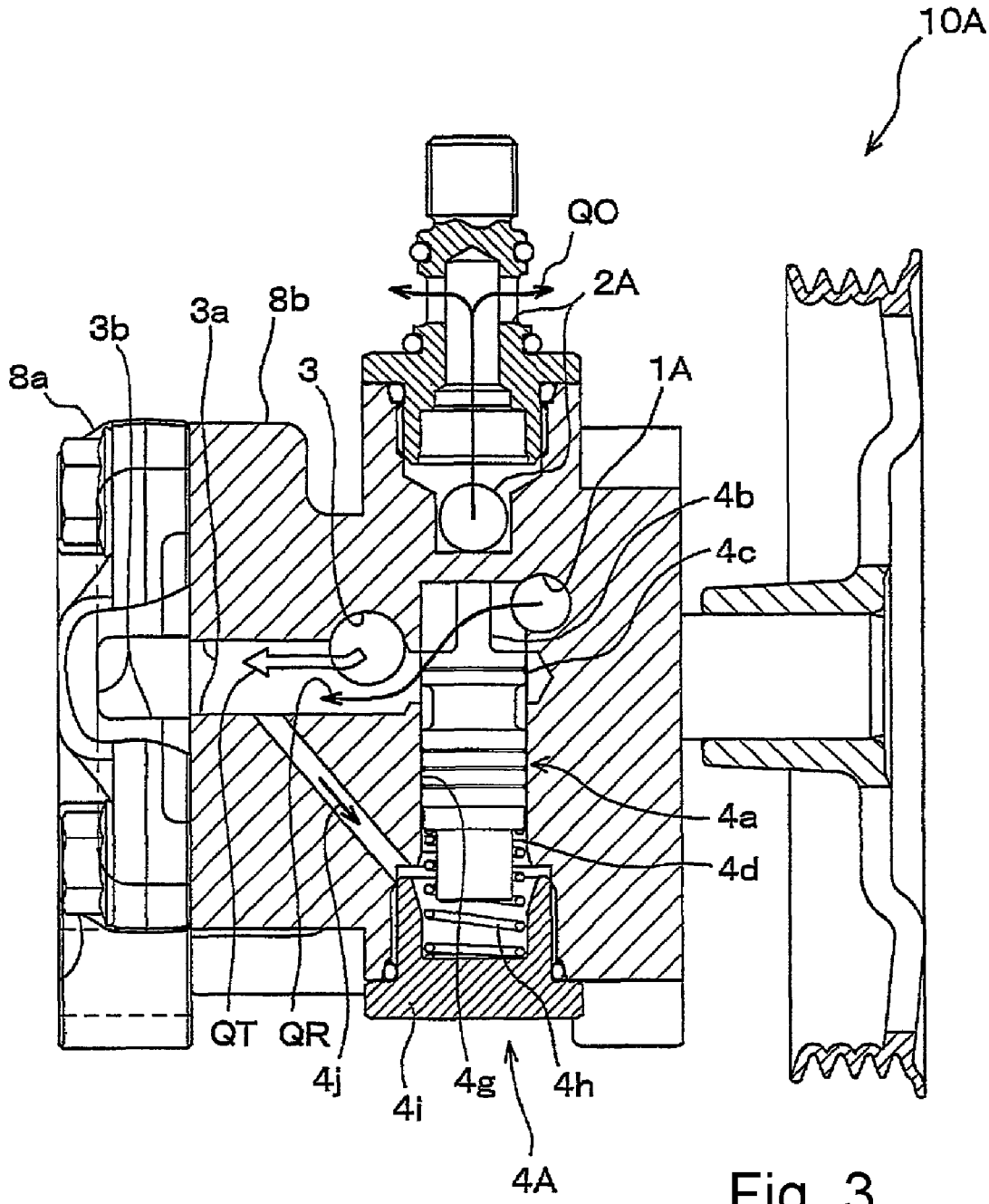
FIG. 3 is a sectional view showing another example of a vane pump in accordance with the present invention.
Figure 4:
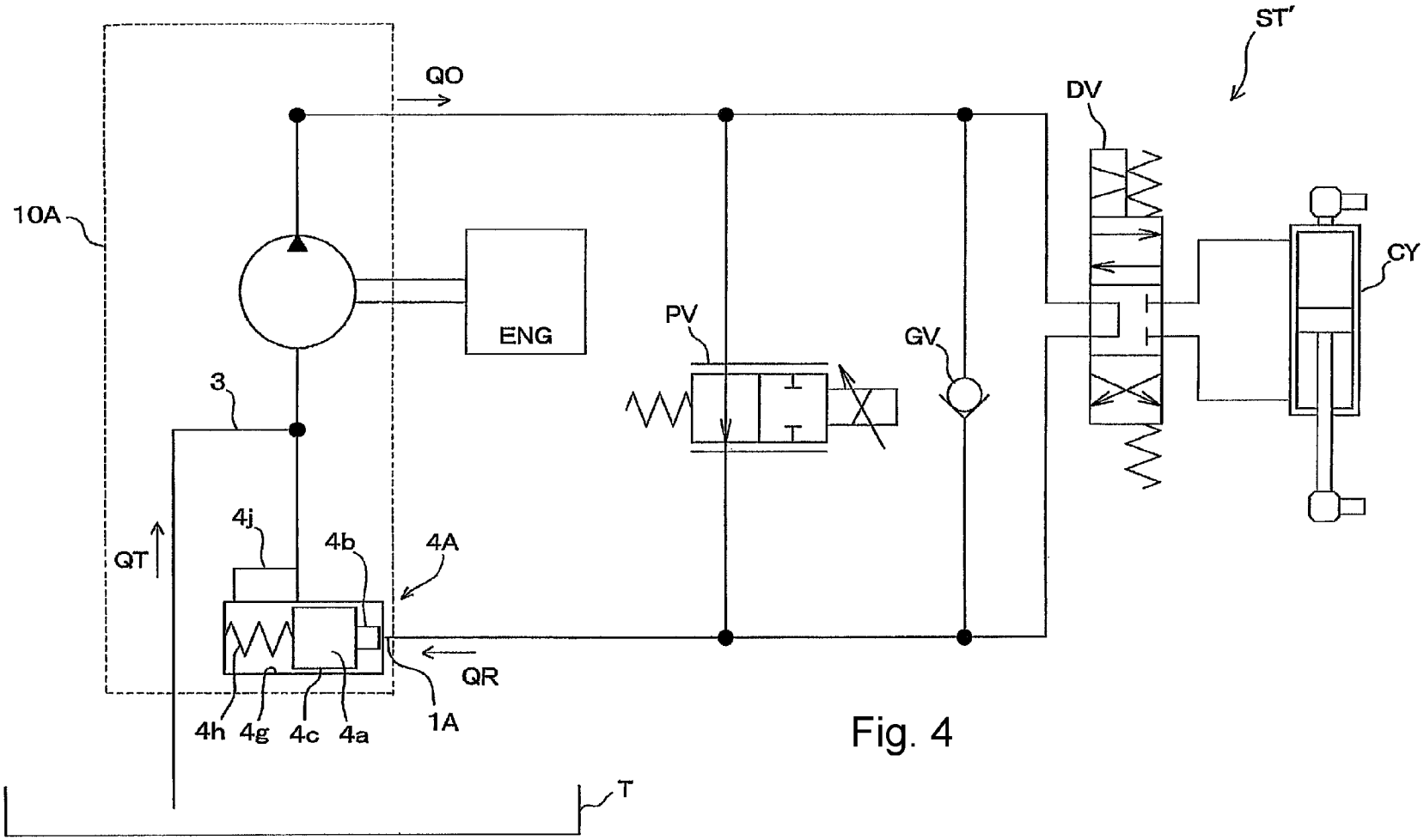
FIG. 4 is a fluid pressure circuit diagram showing fluid pressure-operated equipment using the vane pump shown in FIG. 3.

FIG. 3 is a sectional view showing another example of the vane pump in accordance with the present invention. This sectional view is a sectional view of the same portion of the vane pump of another example as that shown in FIG. 1(*b*). FIG. 4 is a fluid pressure circuit diagram showing fluid pressure operated equipment using the vane pump shown in FIG. 3.

This vane pump 10A differs from the vane pump 10 shown in FIG. 1 in that a throttle valve 4A is not of a fixed type, but is instead a variable throttle valve 4A configured so that the opening amount of the throttle increases as the flow rate of the returning working fluid QR increases.

Also, the vane pump 10A differs from the vane pump 10 in that both of a return port 1A and a delivery port 2A have a construction corresponding to the variable throttle valve 4A, because of a space occupied by the throttle valve 4A in the body 8*b*.

The variable throttle valve 4A includes a valve element 4*a*, which slides when acted upon by the returning working fluid QR, a valve housing portion 4*g*, one side of which is open, and which slidably houses the valve element 4*a*, a lid 4*i* that closes the open side of the valve housing portion 4*g*, a spring 4*h* held between the lid 4*i* and the valve element 4*a* to urge the valve element 4*a* to the closed side of the valve housing portion 4*g* with respect to the lid 4*i*, and a communication path 4*j* that allows the conduit 3*a* and the valve housing portion 4*g* to communicate with each other.

The valve element 4*a* is, as a whole, of a spool shape, one end of which has a small diameter. The valve element 4*a* includes a small-diameter convex portion 4*b* that has the small diameter, a spool portion 4*c* that is continuous with the small-diameter convex portion 4*b* and which has a fluid-tight outside diameter with respect to the inside diameter of the valve housing portion 4*g*, and a spring receiving portion 4*d* that is continuous with the spool portion 4*c* and which has a diameter smaller than the spool portion 4*c* so that the spring 4*h* fits on the outer periphery thereof.

The valve housing portion 4*g* allows the return port 1A and the conduit 3*a* to communicate with each other when the valve element 4*a* is absent. When the returning working fluid QR is absent and thus the valve element 4*a* is still urged by the spring 4*h*, however, the small-diameter convex portion 4*b* comes into contact with the closed side. When this is the case, the return port 1A and the conduit 3*a* are not allowed to communicate with each other by the spool portion 4*c*, or at least the degree of communication is kept low.

The communication path 4*j* allows the conduit 3*a* and a portion in which the spring receiving portion 4*d* of the valve element 4*a* is located under the valve housing portion 4*g* to communicate with each other. Therefore, the returning working fluid QR acts on the small-diameter convex portion 4*b* side of the valve element 4*a* via the communication path 4*j*, and the working fluid in the conduit 3*a* acts on the spring receiving portion 4*d* side, so that a balance is maintained with the urging force of the spring 4*h*.

According to the variable throttle valve 4A configured as described above, even if the returning working fluid QR flows in from the return port 1A, in the case where the flow rate thereof is low, the valve element 4*a* moves slightly downward in FIG. 3 so as to be in balance with the spring 4*h*, which causes the returning working fluid QR to be supplied to the conduit 3*a* in a more throttled state. The more throttled working fluid QR draws the working fluid QT from the suction port 3 at a higher speed.

On the other hand, if the flow rate of the returning working fluid QR from the return port 1A increases, the valve element 4*a* balances in a more opened state, so that the returning working fluid QR is supplied to the conduit 3*a* in a more un-throttled state.

Thus, the throttle opening amount of the variable throttle valve 4A increases as the flow rate of the returning working fluid QR increases.

In the vane pump 10A with the variable throttle valve 4A as described above, when the flow rate of the returning working fluid QR is low, the throttle valve 4A is throttled, so that the flow velocity of the returning working fluid QR increases. On the other hand, as the flow rate thereof increases, the throttle valve 4A is opened, so that the pressure of the returning working fluid QR on the return port 1A side can be prevented from rising excessively.

An active stabilizer ST' shown in FIG. 4 differs from the active stabilizer ST shown in FIG. 2 in that the vane pump 10A has the variable throttle valve 4A explained above with reference to FIG. 3.

Therefore, in this active stabilizer ST', the effect of the above-described vane pump 10 is achieved, and also, as described above, the pressure of the returning working fluid QR on the return port 1A side can be prevented from rising excessively by the vane pump 10A, so that the pressure control valve PV used in the active stabilizer ST' can be prevented from malfunctioning.

The vane pumps 10 and 10A explained above are merely examples of the invention described in the claims. The present invention's scope is not limited to these examples.

The fluid pressure may include pressure in cases in which, for example, water or a high molecular weight working fluid is used as the working fluid, and oil pressure when a hydraulic oil is used as the working fluid.

The vane pump in accordance with the present invention can be used suitably in industrial fields that require a high flow rate of a working fluid, such as an automotive active stabilizer.

What is claimed is:

1. A vane pump comprising:

a vane section operable to pressurize a working fluid;

structure defining a suction port configured to deliver working fluid into the vane section, wherein the suction port is configured to conduct fluid along a suction port flow path;

structure defining a delivery port configured to receive pressurized working fluid from the vane section;

structure defining a return port configured to receive working fluid from the delivery port, wherein the return port is configured to conduct fluid along a return port flow path, and wherein the return port flow path is generally parallel to the suction port flow path;

a throttle valve configured to receive working fluid from the return port and to accelerate the flow of the working fluid by a region of the throttle valve having a cross-sectional flow area less than a cross-sectional flow area of the return port;

structure defining a mixing chamber configured to receive working fluid from a working fluid tank through the suction port and accelerated working fluid from the return port and the throttle valve and to mix those working fluids together before the mixed fluids enter the vane section;

wherein working fluid flows through the suction port and accelerated working fluid from the return port through the throttle valve generally intersect; and wherein the accelerated working fluid from the return port is formed within the vicinity of the suction port.

2. The vane pump of claim 1, wherein a direction of fluid flow through the mixing chamber is generally perpendicular to both of the suction port flow path and the return port flow path.

3. A vane pump comprising:

a pump body;

a vaned rotor inside the pump body, the rotor operable to pressurize a working fluid;

structure defining a suction port configured to deliver the working fluid to the rotor, wherein the suction port is configured to conduct fluid along a suction port flow path;

structure defining a delivery port configured to receive pressurized working fluid from the rotor;

structure defining a return port configured to receive working fluid from the delivery port, wherein the return port is configured to conduct fluid along a return port flow path;

a throttle valve located inside the pump body and configured to receive working fluid from the return port and to accelerate the flow of the working fluid by a region of the throttle valve having a cross-sectional flow area less than a cross-sectional flow area of the return port;

structure defining a mixing chamber configured to mix working fluid together at a location inside the pump body at which a first flow of working fluid from the suction port and a second flow of accelerated working fluid from the return port and the throttle valve first intersect before the mixed first and second fluid flows contact the rotor; and wherein the accelerated working fluid from the return port is formed within the vicinity of the suction port.

4. The vane pump of claim 3, and further comprising structure defining a reservoir that is outside of the pump body and configured to hold a quantity of the working fluid as a reserve for delivery to the suction port.

* * * * *